US005638799A

United States Patent [19]

Kiess et al.

[11] Patent Number: 5,638,799

[45] Date of Patent: Jun. 17, 1997

[54] DOUBLE STRIKE IGNITION CONTROL

[75] Inventors: Ronald J. Kiess, Decatur; Norman H. Bracken, Anderson, both of Ind.

[73] Assignee: General Motors Corporation, Detroit, Mich.

[21] Appl. No.: 651,416

[22] Filed: May 22, 1996

[51] Int. Cl.[6] ..... F02P 15/08

[52] U.S. Cl. ..... 123/637

[58] Field of Search ..... 123/637, 636, 123/634, 618, 606, 414, 643, 595

[56] References Cited

U.S. PATENT DOCUMENTS

| | | | |
|---|---|---|---|
| 3,626,200 | 12/1971 | Sasayama | 123/637 |
| 3,754,541 | 8/1973 | Sasayama | 123/637 |
| 3,926,165 | 12/1975 | Merrick | 123/636 |
| 3,939,811 | 2/1976 | Sasayama | 123/637 |
| 4,100,564 | 7/1978 | Sasayama | 123/637 |
| 4,175,506 | 11/1979 | Sakamoto et al. | 123/637 |
| 4,407,255 | 10/1983 | Butler | 123/595 |
| 4,479,467 | 10/1984 | Burrows et al. | 123/606 |
| 4,653,459 | 3/1987 | Herden | 123/637 |
| 5,107,817 | 4/1992 | Dittman et al. | 123/643 |
| 5,431,044 | 7/1995 | Kiess et al. | 73/117.3 |
| 5,476,084 | 12/1995 | Morganti et al. | 123/637 |
| 5,513,612 | 5/1996 | McAbee et al. | 123/414 |

OTHER PUBLICATIONS

SAE Paper, "Spark Plug Voltage Analysis for Monitoring Combustion in an Internal Combusiton Engine", Shimasaki et al, Mar. 1–5, 1993, 930461.

SAE Paper, "Flame Ion Density Measurement Using Spark Plug Voltage Analysis", Miyata et al, Mar. 1–5, 1993 930462.

*Primary Examiner*—Raymond A. Nelli
*Attorney, Agent, or Firm*—Michael J. Bridges

[57] ABSTRACT

Ignition drive circuitry for generating sequential first and second arcs across electrodes of spark plugs in internal combustion engine cylinders for contributing supplemental combustion energy and for enabling simple, robust misfire detection with a first arc generated through rapid discharge of a storage element and the second arc generated through interruption of said discharge through a transformer primary ignition coil.

20 Claims, 5 Drawing Sheets

DOUBLE STRIKE IGNITION CONTROL

FIELD OF THE INVENTION

This invention relates to automotive internal combustion engine control and, more particularly, to automotive internal combustion engine ignition control.

BACKGROUND OF THE INVENTION

Conventional internal combustion engine control is dominated by single strike ignition systems in which a single spark plug ignition event is provided to ignite an air/fuel mixture in an engine cylinder for each cylinder combustion event. Known single strike ignition systems vary widely from simple to complex. The timing of the single ignition event is carefully controlled to provide for complete combustion of the air/fuel mixture to minimize engine emissions and is timed to vary the torque contribution from the combustion event in the cylinder. Improper timing of the ignition event can result in a cylinder misfire condition which is known to have undesirable performance and emissions consequences. Misfire conditions must be diagnosed in a timely manner and reported so that corrective action can be taken to minimize the potential for further misfire conditions.

An ignition control approach that improves the potential for more complete combustion of an air/fuel mixture in an engine cylinder and that provides for reliable, timely diagnosis of misfire conditions in the cylinder would therefore be desirable. It would further be preferable that such an approach use simple, low cost ignition drive circuitry.

SUMMARY OF THE INVENTION

The present invention is directed to a desirable double strike ignition system comprised of simple, low cost ignition drive circuitry for generating a sequence of first and second timed spark plug ignition events for each cylinder combustion event in an internal combustion engine. The first ignition event provides a combustion arc across the electrodes of a spark plug in an engine cylinder at a controlled time to ignite the air/fuel mixture in the cylinder. The second ignition event is delayed a controlled period of time from the combustion arc and provides a supplemental combustion arc across the spark plug electrodes which contributes heat to the cylinder to enhance the combustion of the air/fuel mixture and which increases the potential for complete consumption of the mixture during the combustion event. The supplemental combustion arc is termed a measurement arc when the double strike ignition system of this invention is coupled to a reliable plasma induced misfire detection system, as the measurement arc allows for "measurement" of combustion in the plasma in the cylinder in proximity to the spark plug electrodes at a time when combustion should be present in the cylinder (from the combustion arc). Without such a measurement arc closely following the combustion arc, a low cost, reliable plasma induced misfire detection would not be possible.

More specifically, this double strike ignition control approach provides for charging of a storage element and for rapid discharge thereof through a primary ignition coil of a transformer in response to a first control signal issued by a controller. A secondary discharge signal is induced in a secondary ignition coil of the transformer, which may be a step-up transformer having opposing ignition coil polarity. The induced signal is transferred to a spark plug for generating a first arc across the electrodes thereof in a first ignition event.

Following a delay period that may, in accord with a further aspect of this invention, vary with an engine operating parameter such as engine speed, the rapid discharge is interrupted in response to a timed second control signal from the controller, causing a flyback pulse through the primary ignition coil. The flyback pulse induces a pulse in the secondary ignition coil which is passed to the spark plug for generating a second arc across the electrodes thereof in a second ignition event. In accord with a further aspect of this invention, a portion of the secondary ignition coil current may be tapped off through an intermediate coil tap to the storage element to recharge the storage element in preparation for a subsequent ignition event, such as in a subsequent engine cycle.

In accord with yet a further aspect of this invention, first and second ignition events may be provided in each of N engine cylinders by selectively coupling the induced signals in the secondary ignition coil to individual transformers, with each such individual transformer dedicated to an individual engine cylinder and only coupled to the secondary ignition coil when said first and second ignition events are desired in the corresponding cylinder.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
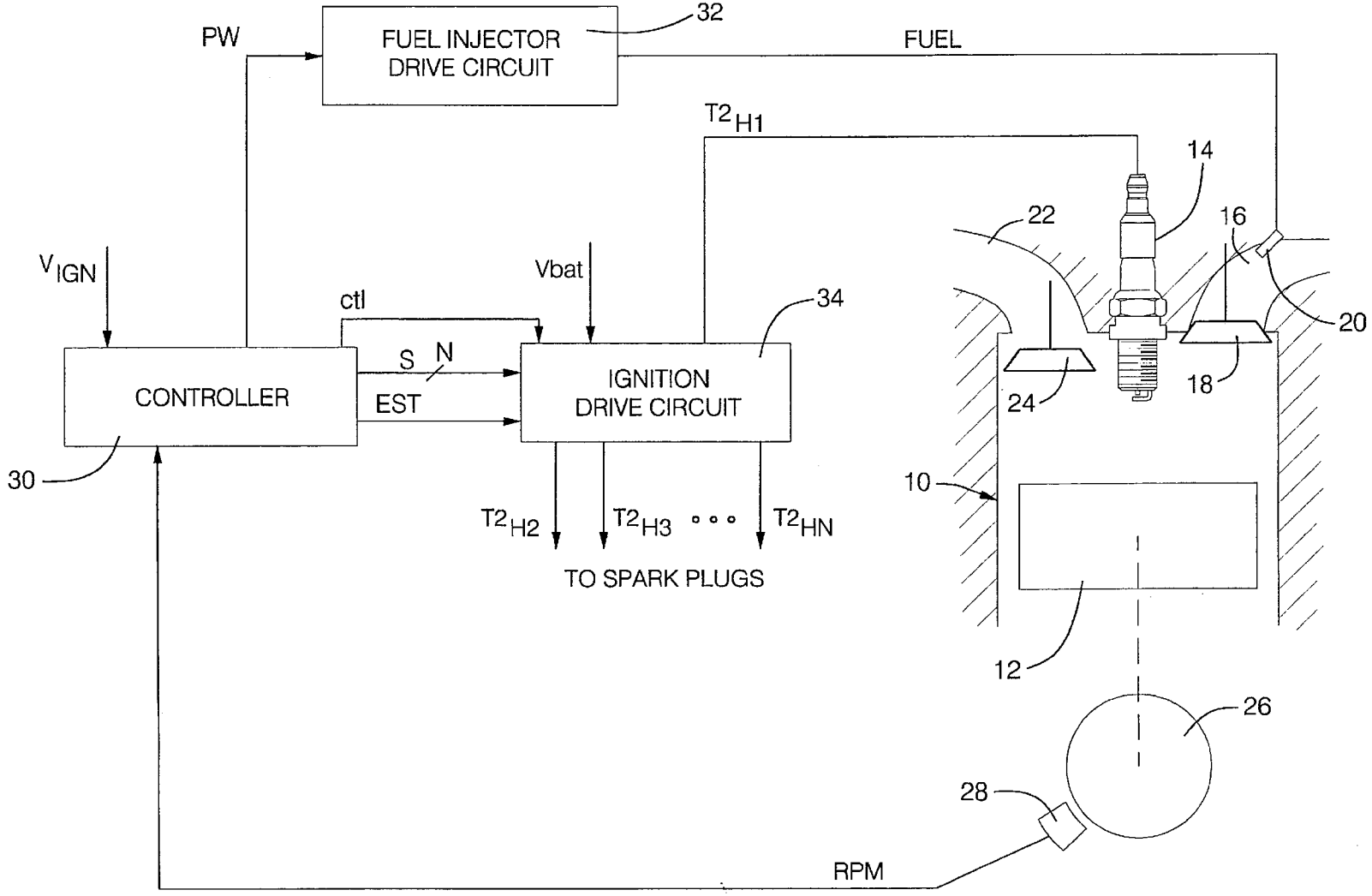
FIG. 1 is a general diagram of engine control hardware applied to an internal combustion engine in accord with the preferred embodiment.

Referring to FIG. 1, an individual cylinder 10 of a multiple cylinder internal combustion engine having N such cylinders is illustrated. Each of the N cylinders includes a piston such as piston 12 disposed within the cylinder 10 and mechanically linked through a connecting rod (not shown) to crankshaft 26 which rotates as the piston 12 reciprocates within the cylinder 10. A plurality of spaced teeth or notches (not shown) are disposed about the crankshaft and pass by variable reluctance or Hall effect sensor 28 which transduces passage of the teeth or notches into cycles of an analog output signal RPM the frequency of which signal is proportional to the rate of rotation of the crankshaft (engine speed) and individual cycles of which signal indicate occurrence of engine cylinder events. Fuel is injected into cylinder intake runner 16 by fuel injector 20 responsive to control signal FUEL and is mixed with an intake air charge that is passed through the intake runner from an engine intake plenum or manifold (not shown).

The air/fuel mixture is drawn into the cylinder 10 while intake valve 18 is driven to an open position open during an intake stroke of the piston 12 within the cylinder 10. The piston intake stroke is followed by a piston compression stroke after which spark plug drive signal $T2_{H1}$, which is applied to the terminal of spark plug 14, is driven to an active level which provides for a surge of current through the spark plug 14 leading to an arc across a spark plug gap between a pair of spark plug electrodes within the engine cylinder 10. The arc, termed a combustion arc in this embodiment, is provided for igniting the air/fuel mixture in the cylinder 10. Signal $T2_{H1}$ is then driven, following a delay period which ranges from about 0.5 milliseconds to about one millisecond in this embodiment, to a second active level which provides for a surge of current through the spark plug 14 leading to yet another arc across the spark plug gap. This second arc is termed a supplemental arc for supplementing heating and combustion of the air/fuel mixture in the engine cylinder 10. In an embodiment of this invention in which a misfire detection circuit is coupled to the system, the second arc is termed a measurement arc as it provides for measurement of a presence of a specific band of frequency trapped in an ignition coil of ignition drive circuit 34 indicating a cylinder misfire condition.

Ignition drive circuit generates and outputs, for each of the N engine cylinders, an output signal $T2_{Hk}$ (for engine cylinder k) providing a timed combustion arc across the gap of the spark plug of the kth engine cylinder followed by a supplemental combustion (measurement) arc across such gap, as described. The timing of the combustion arc is dictated by electronic spark timing signal EST applied to ignition drive circuit 34. A select signal "s" is provided to ignition drive circuit 34 for each of the N engine cylinders. The select signal "s" is driven to an active state for an engine cylinder when a combustion event is desired for such cylinder. As described, the combustion event is desired when an air/fuel mixture has been drawn into the cylinder and following the piston compression stroke. The time delay between the combustion and supplemental combustion arcs in the engine cylinder is dictated by signal "ctl" applied to the ignition drive circuit 34. The construction of the ignition drive circuit 34 is detailed in accord with the preferred embodiment, in FIG. 2. The signal RPM and other conventionally-understood signals indicating, for example, engine parameter values are applied to controller 30 which takes the form of a conventional microprocessor-based vehicle controller including such conventional controller elements as a central processing unit with arithmetic logic circuitry and control circuitry, read only memory circuitry, random access memory circuitry, and input/output circuitry. The controller 30 is activated by application of ignition power Vign thereto, wherein such application may be manually controlled by an engine operator. The controller 30 carries out engine control, diagnostic and maintenance procedures including generating and outputting fuel injector pulse width signal PW to fuel injector drive circuit 32 for timed application of injector drive signal FUEL to individual cylinder fuel injectors, such as injector 20 of cylinder 10. The injector drive circuit 32 transforms signal PW into a drive signal FUEL that provides for a period of opening of fuel injector 20 to allow a pulse of pressurized fuel to pass therethrough and into intake runner 16 for mixing with intake air passing through the intake runner. The controller 30 also issues signals EST, "ctl" and the N select signals "s" to the ignition drive circuit 34 for ignition timing control. The controller generates signal ctl as a function of engine speed indicated by signal RPM. Specifically in this embodiment, the signal ctl is set to a signal level corresponding to approximately 1.0 milliseconds between the combustion and supplemental combustion arcs for engine speeds up to 4000 r.p.m., and to a signal level corresponding to approximately 0.5 milliseconds between arcs for engine speeds above 4000 r.p.m. The ignition drive circuit 34 and the misfire detection circuit 36 are electrically driven by a system power source, such as voltage Vbat from a vehicle battery (not shown).

Figure 2:
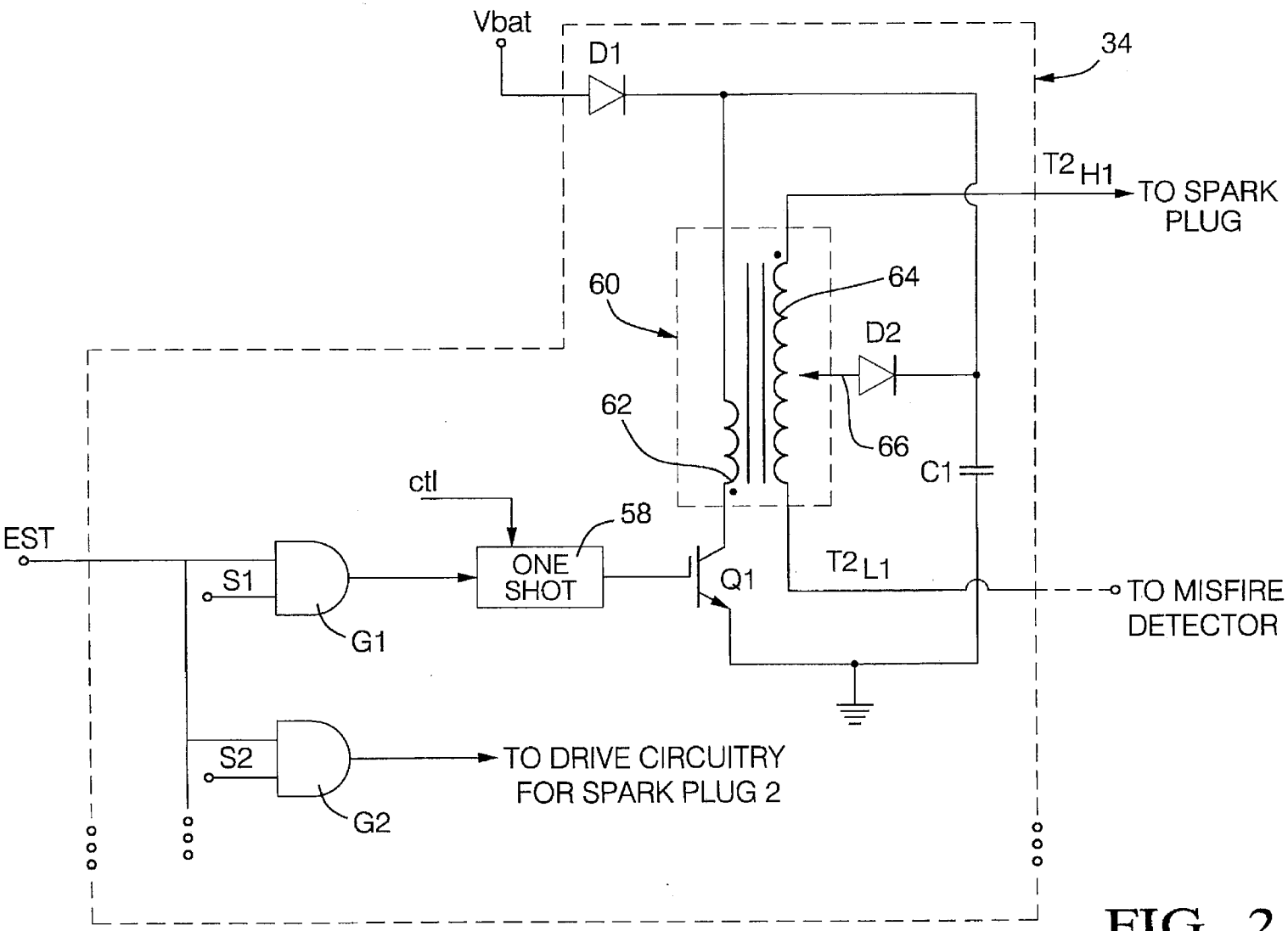
FIG. 2 is a schematic diagram of the ignition control circuit of FIG. 1.
Figures 3A, 3B, 3C, 3D, 3E, 3F, 3G:
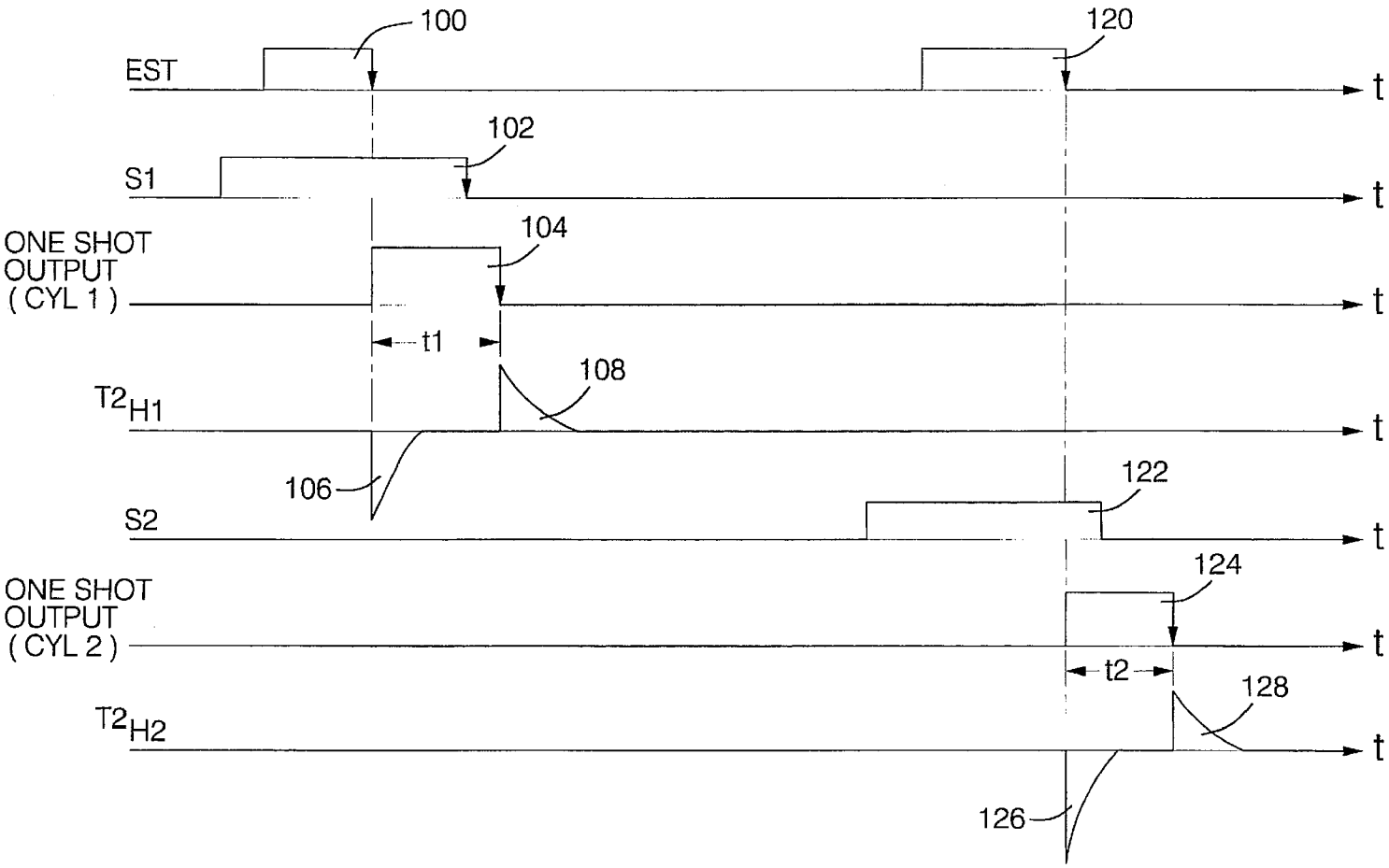
FIGS. 3*a*–3*g* are signal timing diagrams illustrating representative ignition drive signals for the ignition drive circuit of FIG. 2.

Referring to FIG. 2, a preferred implementation of the ignition drive circuit 34 of FIG. 1 is illustrated. Signal EST is passed as an input to N, two-input logic "AND" gates G1-GN. "AND" gate GK is assigned to drive circuitry for the spark plug of a Kth engine cylinder. The other input to the N "AND" gates is a respective select signal sN, wherein index "N" indicates which of the N cylinders is active. The signals are provided such that the output of an "AND" gate GK will be a logic high, which is an active level in this embodiment, when EST is high and the cylinder K is selected by controller 30 of FIG. 1 as active. The "AND" gate output for each of the N "AND" gates is provided to a corresponding one of N individual ignition drive circuits of identical construction making up the overall circuit 34 of this embodiment, only one of such circuits being illustrated, for brevity, corresponding to cylinder 1. The inventors intend that, in accord with this invention, a plurality of dedicated control lines may be provided from the controller 30 of FIG. 1. Each of the plurality may extend directly to drive circuitry for a corrsponding spark plug. Signals then can be issued from the controller 30 via the control lines to directly provide cylinder select and ignition drive circuit control functions, such that the cylinder select function provided through the gates G1-GN is not required. Further, the signals from the controller may be provided with a rising and falling edge timed to supplant the function described herein for one-shot 58 and its counterpart one-shots for other ignition drive circuits of this embodiment.

Specifically, the "AND" gate output is provided to conventional one shot 58 which is configured to be active on the falling edge of the input signal and which, when active, outputs a positive voltage pulse of duration set in accord with control signal ctl. The one-shot 58 output is applied to the base of conventional transistor Q1 of the integrated gate bipolar type. The one-shot may be implemented in any conventional manner including through well-known 555 timer hardware implementations. The emitter of transistor Q1 is tied to a ground reference and the collector to a low side of the primary winding 62 of conventional step-up transformer 60 having approximately a 1:100 winding ratio and an inverse winding polarity. The high side of the primary winding 62 (opposing the low side thereof) is tied to battery voltage Vbat through diode D1 and is electrically tied to a high side of capacitor C1 of about two microFarads. The low side of C1 is connected to the ground reference. An electrical tap 66 is provided along the secondary winding (or coil) 64 to anode of diode D2, the cathode of D2 being tied to the high side of capacitor C1. The high side of secondary winding 64 provides output spark plug drive signal $T2_{H1}$ to the terminal of spark plug 14 of FIG. 1 and the low side of the secondary winding 64 (opposing the high side thereof) is provided as output signal $T2_{L1}$ which may, if cylinder misfire detection is desired in an application of this invention, be provided to a misfire detection circuit, such as the circuit 36 of FIG. 2 fully described in the incorporated reference.

Functionally, transistor Q1 is turned on with the rising edge of the output signal of one shot 58 which occurs at the falling edge of signal EST. It should be noted that select signals s1-sN are, when set, in a high state for a period of time substantially longer than even the longest possible duration of the EST pulse in this embodiment, such that the EST pulse governs the time of occurrence of the rising edge of the output signal of any of the "AND" gates G1-GN. When Q1 turns on, the capacitor C1, which has previously been charged up to between 250–400 volts, is rapidly discharged through the primary winding 62 of the transformer 60 inducing a surge of current of negative polarity (due to the inverse winding polarity of the transformer 60) through the secondary winding 64 of the transformer which passes as signal $T2_{H1}$ to the spark plug terminal and across the electrodes thereof providing a combustion arc across the spark plug gap to ignite the air/fuel mixture in the engine cylinder 10. The voltage on C1 also operates to reverse bias diode D1 to prevent current flow from the vehicle battery. As the capacitor C1 rapidly discharges through the primary winding 62 of transformer 60, the diode D1 switches to a forward biased state, allowing current from the vehicle battery to flow through the primary winding 62. Current from the battery ramps up in the primary winding 62 until the output pulse from the one shot 58 falls at the time of the desired issuance of the supplemental combustion (measurement) arc, turning off transistor Q1, which produces a flyback pulse of positive polarity at the low side of the primary winding 62. The step-up transformer 60 transforms this flyback pulse into a higher magnitude pulse through the secondary winding 64 and to the terminal of the spark plug 14 (FIG. 1) and across the gap thereof producing a supplemental combustion arc in the engine cylinder 10 about 0.5–1.0 milliseconds after the combustion arc, increasing the potential for complete combustion and providing for misfire detection in accord with an embodiment coupled to the misfire detection circuit described in the incorporated reference. The secondary winding of transformer 60 may be referenced to a ground reference through a pull down resistor, not shown, or may be referenced to ground reference through coupling to a misfire detection circuit, such as through the coupling detailed in FIG. 2 of the incorporated reference. During the flyback pulse, a portion of the current in the secondary winding 64 is tapped via tap 66 through diode D2 to recharge capacitor C1. Prior to occurrence of the flyback pulse, diode D2 is reverse biased, preventing such recharging of C1.

FIGS. 3*a*–3*g* illustrate timing of ignition control and drive signals of the circuit of FIG. 2 for a first and second engine cylinder in a cylinder firing order. Specifically, signal s1 102 is high while the first engine cylinder (designated CYL 1 in FIG. 2) is active, requiring a combustion event therein as described. The output of "AND" gate for CYL 1 will therefore be driven to a high state while s1 102 is in a high state on the rising edge of spark timing signal EST 100 and will drop to a low state on the falling edge of EST pulse 100, which falling edge activates the one shot for CYL 1 to a high level 104. The rising edge of the one shot output 104 turns on transistor Q1 of FIG. 2 providing, as described, for rapid discharge of capacitor C1 which is stepped up via the transformer 60 of FIG. 2 providing the negative polarity drive signal $T2_{H1}$ 106 which is applied to the spark plug terminal creating a combustion arc across the spark plug gap. Pulse $T2_{H1}$ rapidly decays to zero as the capacitor C1 of FIG. 2 discharges.

A period of time t1 following the rising edge of the one shot output 104 wherein t1 is dependent on engine speed, as described, the one shot output drops to a low level, turning off the transistor Q1 of FIG. 2 generating the transformer flyback pulse of positive polarity 108 which drives the supplemental combustion arc across the spark plug gap for generating supplemental heating of the air/fuel mixture in the engine cylinder 10 of FIG. 2 and supporting misfire detection as described.

The ignition drive signals for the N-1 inactive cylinders remain in an inactive state during this drive procedure for cylinder CYL 1. However, for the next ignition event for a next engine cylinder (designated CYL 2 in FIG. 3*c*) in the engine firing order, the signal EST 120 is gated only through to a one shot corresponding to CYL 2 via (such as via "AND" gate G2 of FIG. 2 as only select signal s2 is driven by controller 30 of FIG. 1 to a high (active) state indicated by pulse 122 of FIG. 3*e*. The "AND" gate for the second cylinder in the firing order (CYL 2) is thus high for the duration of the EST pulse 120, having a falling edge substantially contemporaneous with the falling edge of EST pulse 120 at which falling edge the output of the one shot corresponding to CYL 2 is driven to a high state indicated by signal 124 of FIG. 3*f*. On the rising edge of signal 124, a capacitor corresponding to C1 of FIG. 2 is discharged, the discharging voltage being stepped up through step up transformer (not shown for CYL 2 but corresponding to transformer 60 of FIG. 2) and applied as pulse $T2_{H2}$ 126 of negative polarity to a spark plug of cylinder CYL 2 for generating a combustion arc across the gap thereof to ignite an air/fuel mixture present in cylinder CYL 2. Pulse $T2_{H2}$ rapidly decays to zero as the corresponding capacitor discharges.

A period of time t2 following the rising edge of the one shot output 124 wherein t2 is dependent on engine speed, as described, the one shot output 124 drops to a low level, turning off the transistor such as corresponding to Q1 of FIG. 2, generating the transformer flyback pulse of positive polarity 128 which drives the supplemental combustion arc across the spark plug gap for supplemental cylinder combustion heat and for misfire detection, as described.

Figure 4:
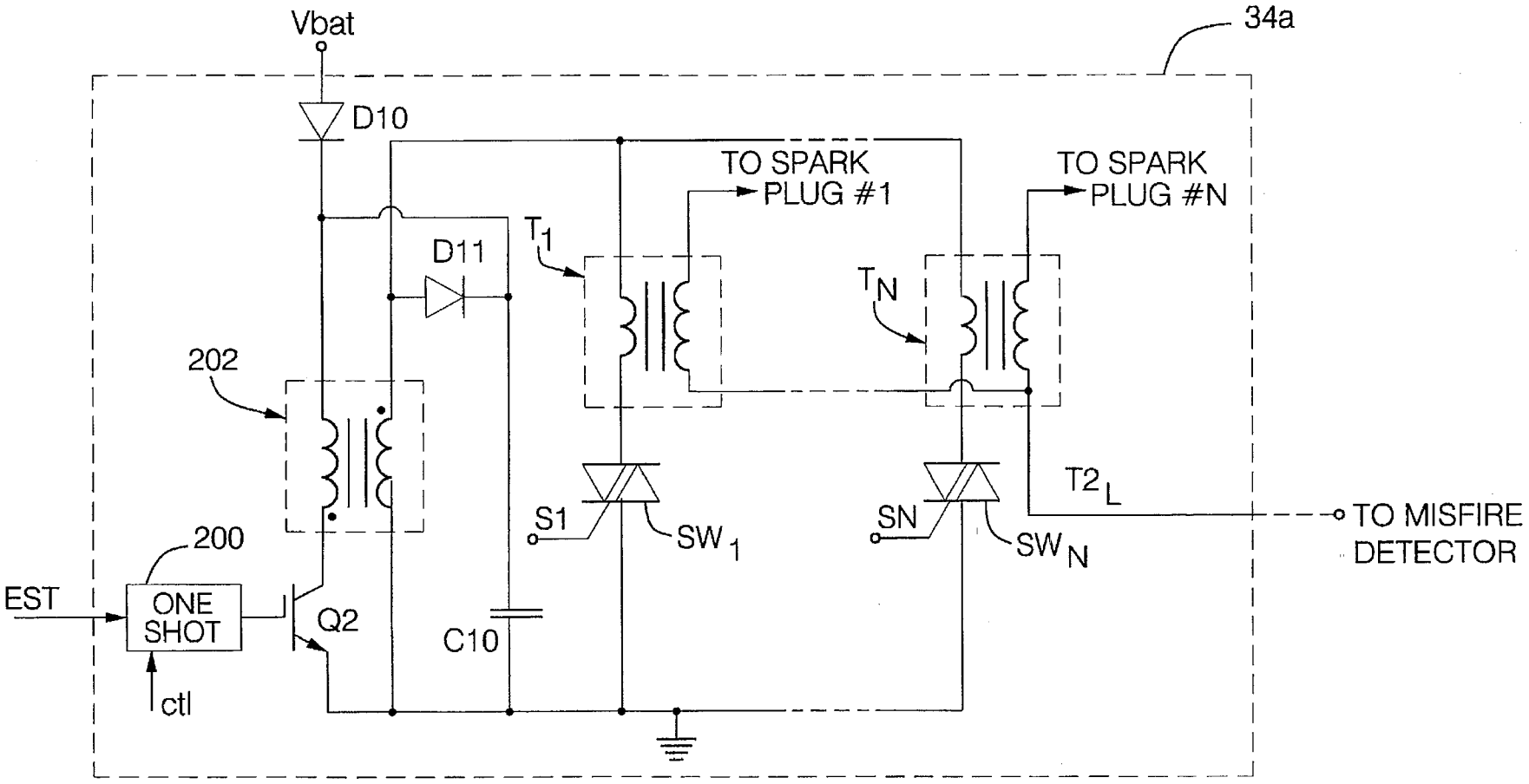
FIGS. 4 and 5 are schematic diagrams of first and second alternative embodiments of the ignition control circuit of this invention.

Referring to FIG. 4, an alternative dual strike ignition drive circuit 34*a* is illustrated in accord with an alternative embodiment of this invention in which a spark plug (not shown) of each of N engine cylinders is driven by the ignition drive circuit 34*a*. Each cylinder has corresponding ignition drive circuitry in the circuit 34*a* including, for a cylinder K of the N engine cylinders, a conventional step-up transformer $T_K$ controlled by a semiconductor switch $SW_K$ coupled to the low side of the primary winding of the corresponding transformer $T_K$. The switches $SW_1$ through $SW_N$ may be implemented as commercially-available bi-directional thyristors (TRIACs) and are driven by respective controller-issued select signals s1 through sN for each of respective cylinders 1 through N, such as corresponding to the described signals s1-sN of FIG. 2. The signals s1 through sN are normally low, and are set high for a cylinder when that cylinder is active requiring an ignition event, as described for FIG. 2, to switch the corresponding triac to a conductive state. The rising edge of each signal s1 through sN occurs when the corresponding cylinder is active on or before the falling edge of the current EST signal issued by controller (such as controller 10 of FIG. 1). Specifically, in this alternative embodiment, for engine speed below 4000 r.p.m., the signals s1 through sN will have a falling edge occurring about 1.0 milliseconds following the falling edge of controller-issued signals EST, and will otherwise have a falling edge occurring about 0.5 milliseconds following the falling edge of EST.

Spark timing signal EST is applied through a conventional one shot 200, implemented in the manner described for the one shot of FIG. 2 such that on the falling edge of EST, the one shot output is driven to a high state for a period of time dictated by control input ctl. ctl may be set to provide for a one shot pulse width of between 0.5 and 1.0 milliseconds depending on engine speed, as indicated by signal RPM of FIG. 1 and as described for the one shot of FIG. 2. The one shot 200 output is applied to the base of integrated gate bipolar transistor IGBT Q2 with the collector of Q2 coupled to the low side of the primary winding of transformer 202. The emitter of Q2 is tied to a ground reference. The high side of the transformer 202 primary winding is coupled to the cathode of diode D10, the anode of which is coupled to Vbat. The cathode of D10 is further coupled to a high voltage side of capacitor C10 of about two microFarads, the opposing low side of which is tied to a ground reference. Cathode of diode D11 is coupled to the high side of C10 and anode of D11 is coupled to the high side of the secondary winding of transformer 202. The low side of the secondary winding of transformer 202 is coupled to the ground reference. The high side of the secondary winding of transformer 202 is coupled to the primary winding of each of N transformers $T_1$ through $T_N$, with the low side of the primary winding coupled to the corresponding triac $SW_1$ through $SW_N$. Each triac $SW_1$ through $SW_N$ is coupled to the ground reference providing for a grounding of the low side of the primary winding of its corresponding transformer when the select input to the switch (s1 though sN) is set to a high state.

Functionally, when the falling edge of signal EST is applied to one shot 200, the one shot output is driven to a high state, turning Q2 on, allowing charged up capacitor C10 to discharge through the primary winding of reverse polarity transformer 202 having about a 1:1 winding ratio. A negative high voltage pulse is thereby induced in the secondary winding of transformer 202 and passes to the active (Kth) transformer (from transformers $T_1$ through $T_N$) corresponding to a conductive triac $SW_K$. The transformers $T_1$ through $T_N$ are step up transformers of about a 1:100 winding ratio. The high voltage pulse induced in the secondary winding of the active transformer $T_K$ drives a surge of current through the corresponding spark plug and across the electrodes thereof, providing a combustion arc in the Kth engine cylinder. The high d.c. voltage on the high voltage side of capacitor C10 is applied to the cathode of diode D10 preventing current flow from Vbat sourced from the battery (not shown). C10 is rapidly discharged through the primary winding of transformer 202, providing that D10 is soon forward biased, allowing battery current to flow through the primary winding of transformer 202. Battery current ramps up in the primary winding of transformer 202 until the output of one shot drops low, which turns off Q2 producing a flyback pulse of positive polarity at the end of the primary winding of transformer 202 coupled to the collector of Q2. This flyback pulse is transformed into a higher magnitude positive pulse through the secondary winding of the transformer 202 and output to the primary winding of the transformer $T_K$ having an active (conductive) triac $SW_K$, inducing a surge of current trough the secondary winding of $T_K$ applied to the corresponding (Kth) spark plug terminal and across the electrodes thereof, producing a supplemental combustion (measurement) arc thereacross. As described for the secondary winding 64 of the transformer 60 of FIG. 2, the flyback pulse may be provided as an output pulse $T2_L$ to a misfire detection circuit, such as the misfire detection circuit described in FIGS. 2 or 4 of the incorporated reference. The secondary winding of each of the transformers T1 through TN is referenced to a ground reference through a pull down resistor (not shown) or through the misfire detection circuit, as described in the incorporated reference. During the flyback pulse, a portion of the current passing the through the secondary winding of transformer 202 is tapped off by diode D11 to recharge capacitor C10. During the first pulse, D11 is reverse biased. The signal diagrams of FIGS. 3*a*–3*g* illustrate ignition drive signal flow through a representative portion of the circuit of FIG. 4 for a first and second of the N engine cylinders, which first and second cylinder are adjacent in the ignition firing order.

Figure 5:
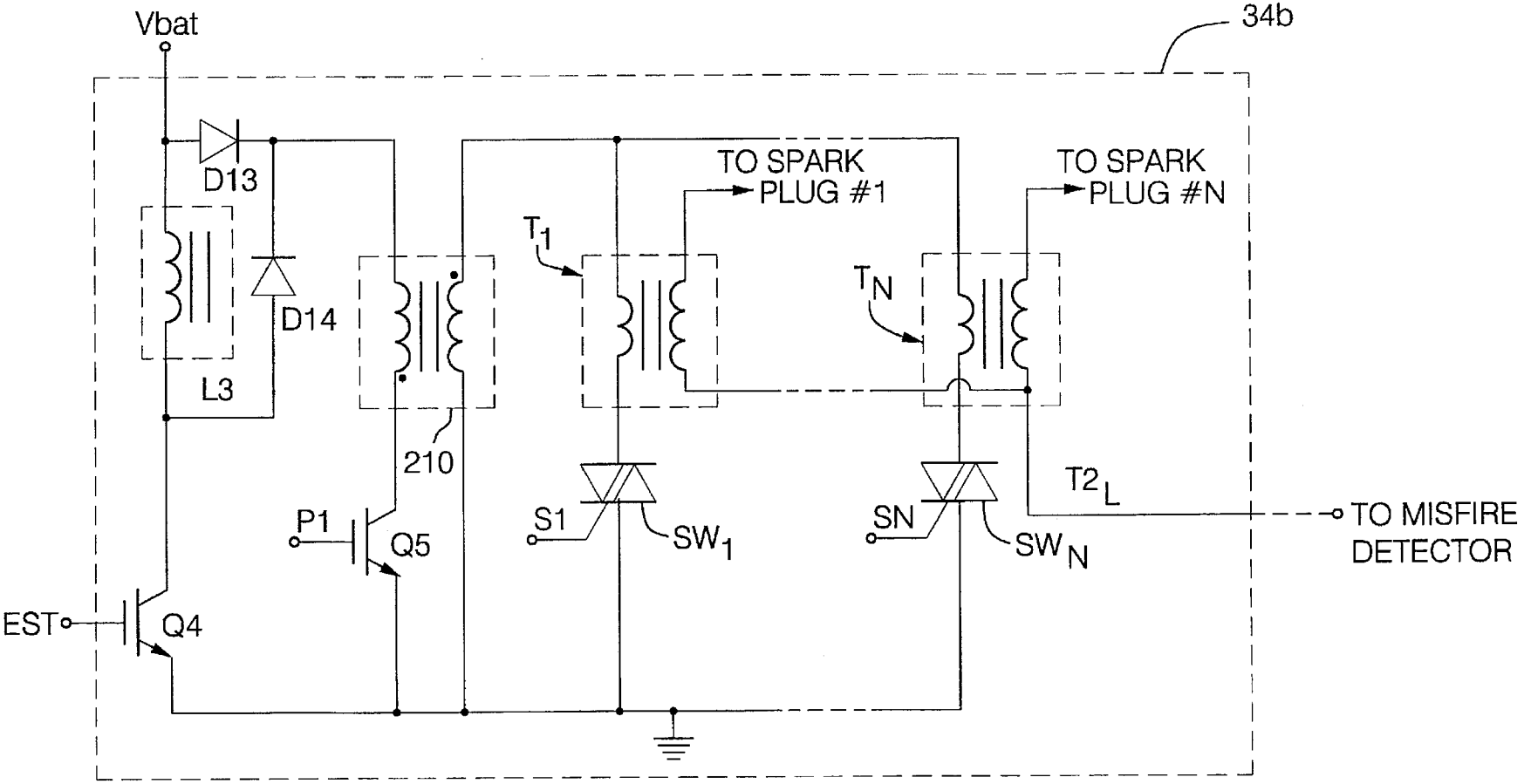

Referring to FIG. 5, an alternative embodiment of the double strike ignition system of this invention is illustrated. Ignition drive circuit 34*b* is provided for driving spark plugs of each of N engine cylinders to deliver a combustion arc across the gap thereof followed by a supplemental combustion or measurement arc. The ignition drive circuit 34*b* shares many components with the described ignition drive circuit 34*a* of FIG. 4, including N step-up transformers $T_1$ through $T_N$ each having coupled to the low side of the primary winding thereof a semiconductor bi-directional switch $SW_1$ through $SW_N$ normally in an open circuit state and driven to a closed circuit (conductive) state by a logic one pulse on a normally low, controller 30 issued, timed control signal s1 through sN, respectively. The low side of the secondary winding of each of the N transformers are coupled together and passed as signal $T2_L$ which may be referenced to a ground reference through a pull down resistor or may be coupled to a ground reference through application to a misfire detection circuit such as that described in the incorporated reference. Each of the switches $SW_1$ through $SW_N$ are coupled to the ground reference for "grounding" the low side of the primary winding of the corresponding transformer when the switch is in a closed circuit state.

The circuit of FIG. 5 provides, for driving each of the N transformers $T_1$ through $T_N$, transistor Q4 of the integrated gate bipolar type having a base coupled to the controller 30 issued signal EST, a collector coupled to the low side of storage inductor L3 of between one and eight milliHenrys and the emitter coupled to the ground reference. The high side of L3 (opposing the low side thereof) is coupled to a battery voltage source Vbat which is also coupled to the anode of diode D13. The cathode of D13 is coupled to the cathode of diode D14, with the anode of D14 tied to the low side of L3. The high side of the primary winding of conventional transformer 210 is tied to the node between the cathodes of D13 and D14. The low side of the primary of transformer 210 (opposing the high side thereof) is coupled to the collector of transistor Q5 of the integrated gate bipolar type, with the emitter of Q5 tied to the ground reference. Applied to the base of Q5 is signal P1, which is a control pulse generated by logic "OR'ing" signals s1 through sN and signal EST together, wherein the timing of s1 through sN is controlled so they are of between 0.5 and 1.0 milliseconds in duration as determined as a function of engine speed, as described for the select signals of FIGS. 2 and 4.

Generally, signal P1 is a control signal having a rising edge at each rising edge of signal EST and a falling edge following each rising edge at each falling edge of any active signal s1 through sN. s1 through sN are generated as described for the circuit of FIG. 4. The low side of the secondary winding of transformer 210 is coupled to the ground reference and the high side of the secondary winding of transformer 210 is coupled to the high side of the primary windings of transformers $T_1$ through $T_N$.

Functionally, Q4 is turned on when signal EST is driven by controller 30 of FIG. 1 to a high state and Q5 is turned on at the same time by P1 being driven to a high state, as described. Current ramps up in the storage inductor L3 until the falling edge of EST is applied to the base of Q4, turning Q4 off. The interruption of current in L3 induces a positive "flyback" pulse of a magnitude L*(di/dt) at the collector of Q4 which is further transferred to transformer 210 by diode D14, and by Q5 which is still on due to the pulse P1 which remains on for a period of time between 0.5–1.0 milliseconds beyond the duration of EST, as described. During this time, current has also been ramping up in the primary winding of transformer 210 but is interrupted temporarily by the described flyback pulse applied to the cathodes of diodes D13 and D14, reverse biasing (temporarily) D13 until the flyback pulse is transferred through transformer 210 and into the transformer TK from the ground T1 through TN corresponding to the active engine cylinder, i.e. the transformer having a switch $SW_K$ currently being driven to a closed circuit (conductive) state. Current then resumes ramping the transformer 210 until the pulse sK drops to a low level. This described process repeats for successive EST pulses applied to the base of Q4.

The short pulse sK is applied to the active switch SWK just long enough to ensure the second flyback pulse is transferred from transformer 210 to the transformer TK that is associated with the cylinder to receive the combustion and supplemental combustion arcs. The transferred pulses are of alternative polarity as in the previously described embodiments of this invention. The remaining configuration and function of the circuitry of FIG. 5 is identical to that previously described for the circuits of FIG. 2 and of FIG. 4 and is not repeated.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. An internal combustion engine ignition control method for generating sequential first and second arcs across spaced electrodes of a spark plug in an engine cylinder for igniting an air/fuel mixture in the engine cylinder, comprising the steps of:

charging an electrical storage element;

issuing a control signal to an ignition control switch to drive the switch to a predetermined state;

discharging the charged electrical storage element through a primary ignition coil of a transformer when the ignition control switch is driven to the predetermined state;

the discharge through the primary ignition coil inducing a secondary signal through a secondary ignition coil of the transformer;

transferring the secondary signal to the spark plug for generating the first arc across the electrodes of the spark plug;

interrupting, following a predetermined delay period, the discharge to generate a flyback signal through the primary ignition coil of the transformer;

the flyback signal inducing a secondary flyback signal in the secondary coil of the transformer; and transferring the secondary flyback signal to the spark plug for generating the second arc across the electrodes of the spark plug.

2. The method of claim 1, further comprising the step of:

diverting a portion of the flyback signal to the electrical storage element to charge the electrical storage element.

3. The method of claim 1, wherein the predetermined state is a conductive state and the discharging step discharges the charged storage element through the primary ignition coil of the transformer and through the ignition control switch when the ignition control switch is driven to the conductive state.

4. The method of claim 3, wherein the interrupting step further comprises the step of:

issuing an additional control signal to the ignition control switch to drive the ignition control switch to a non-conductive state to prevent further discharge through the primary ignition coil and the ignition control switch.

5. The method of claim 1, further comprising the steps of:

sensing a predetermined engine parameter; and setting the predetermined delay period as a function of the sensed predetermined engine parameter.

6. The method of claim 5, wherein the predetermined engine parameter is engine speed.

7. The method of claim 1 for an N cylinder internal combustion engine each cylinder having at least one corresponding spark plug with spaced electrodes and a step-up transformer coupled between the at least one spark plug and the secondary ignition coil, the method further comprising the steps of:

identifying an active cylinder;

admitting an air/fuel mixture to the active cylinder;

issuing a select signal indicating the active cylinder for activating the step-up transformer corresponding to the active cylinder;

and wherein the secondary signal and the secondary flyback signal are transferred to the at least one spark plug corresponding to the active cylinder across the activated step-up transformer to ignite the air/fuel mixture.

8. The method of claim 1, wherein the electrical storage element is a capacitor.

9. The method of claim 1, wherein the electrical storage element is an inductor.

10. An internal combustion engine ignition drive circuit for generating sequential first and second drive pulses applied to a terminal of a spark plug having spaced electrodes in an engine cylinder to produce sequential first and second arcs across the electrodes, comprising:

a transformer having a primary and a secondary ignition coil, each ignition coil having opposing upper and lower electrical terminals;

an electrical storage element coupled to a voltage supply and to the upper electrical terminal of the primary ignition coil;

a switch element electrically connected between the lower electrical terminal of the primary ignition coil and a ground reference and having a control input;

an ignition timing controller for generating sequential first and second control signals having a predetermined time delay therebetween for indicating a desired timing of occurrence of the first and second arcs;

a conductor coupled between the upper electrical terminal of the secondary ignition coil and the spark plug terminal;

wherein the switch element is driven to a first state upon application of the first control signal to the control input providing for discharge of the storage element through the primary ignition coil with a first electrical polarity which induces a drive signal in the secondary ignition coil and through the conductor to the spark plug terminal for generating the first arc across the spark plug electrodes, and wherein said discharge through the primary ignition coil is interrupted by application of the second control signal to the control input driving the switch element to a second state, the discharge interruption generating a flyback signal of a second electrical polarity opposing the first electrical polarity through the primary ignition coil which induces a drive signal through the secondary ignition coil and through the conductor to the spark plug terminal for generating the second arc across the spark plug electrodes.

11. The circuit of claim 10, wherein the primary and secondary ignition coil of the transformer are of opposing electrical polarity.

12. The circuit of claim 10, wherein the switch element is a transistor element having a collector coupled to the lower electrical terminal of the primary ignition coil, an emitter coupled to the ground reference, and a base coupled to the control input.

13. The circuit of claim 10, wherein the predetermined time delay between the first and second control signals is determined as a function of an engine operating parameter.

14. The circuit of claim 10, wherein the ignition timing controller issues a pulse having a pulsewidth corresponding to the predetermined time delay, and wherein the first control signal is a rising edge of the issued pulse and the second control signal is a falling edge of the issued pulse.

15. The circuit of claim 10, wherein the electrical storage element is coupled to the upper terminal of the primary ignition coil across an additional transformer.

16. The circuit of claim 10, further comprising:

a diode coupled between the electrical storage element and an intermediate electrical terminal on the secondary ignition coil between the upper and lower electrical terminals of the secondary ignition coil, for transferring a portion of the induced drive signal in the secondary ignition coil to the electrical storage element for at least partially recharging the electrical storage element.

17. The circuit of claim 10, wherein the electrical storage element is a capacitor.

18. The circuit of claim 10, wherein the electrical storage element is an inductor.

19. A double strike ignition control circuit coupled between an ignition controller and a spark plug having spaced electrodes disposed in an engine cylinder, comprising:

a step-up transformer having a primary and a secondary ignition coil, each ignition coil with opposing upper and lower electrical terminals;

a switch element coupled between the lower electrical terminal of the primary ignition coil and a ground reference, the switch element responsive to a control input signal issued by the ignition controller;

an electrical storage element coupled between the upper electrical terminal of the primary ignition coil and the ground reference;

an electrical conductor coupled between the upper electrical terminal of the secondary ignition coil and the spark plug;

a voltage supply;

a diode coupled between the voltage supply and the upper electrical terminal of the primary ignition coil;

a first control signal applied to the switch element for driving the switch element to a conductive state for discharging the electrical storage element through the primary ignition coil and through the switch element, inducing a drive signal through the secondary ignition coil and through the conductor to the spark plug for generating a first arc across the spark plug electrodes;

a second control signal, following the first control signal by a predetermined delay time and applied to the switch element for driving the switch element to a non-conductive state thereby interrupting said discharging of the electrical storage element and generating a flyback signal through the primary ignition coil which induces a flyback signal through the secondary ignition coil and through the conductor to the spark plug for generating a second arc across the spark plug electrodes.

20. The circuit of claim 19, further comprising:

a diode coupled between the electrical storage element and an intermediate coil terminal of the secondary ignition coil between the upper and lower electrical terminals thereof, the diode for circulating a portion of the flyback signal from the secondary ignition coil to the electrical storage element for charging the electrical storage element.

* * * * *